United States Patent [19]

Herriott et al.

[11] Patent Number: 4,583,021

[45] Date of Patent: Apr. 15, 1986

[54] ELECTRON GUN WITH IMPROVED CATHODE AND SHADOW GRID CONFIGURATION

[75] Inventors: Ronald W. Herriott, San Bruno; Johann R. Hechtel, Redwood City, both of Calif.

[73] Assignee: Litton Systems, Inc., Woodland Hills, Calif.

[21] Appl. No.: 485,780

[22] Filed: Apr. 18, 1983

[51] Int. Cl.[4] ..... H01J 1/46; H01J 21/10

[52] U.S. Cl. ..... 313/304; 313/309; 313/348; 313/447; 313/449; 313/454; 315/5.37

[58] Field of Search ..... 313/348, 346, 296, 302, 313/304, 446, 447, 448, 449, 454, 309; 315/5.36, 5.37

[56] References Cited

U.S. PATENT DOCUMENTS

| | | | |
|---|---|---|---|
| 3,377,492 | 4/1968 | Oess | 313/348 X |
| 3,484,645 | 12/1969 | Drees | 313/296 X |
| 3,500,107 | 3/1970 | Beggs | 313/348 |
| 4,023,061 | 5/1977 | Berwick et al. | 313/348 |
| 4,371,809 | 2/1983 | Thomas et al. | 313/449 |

*Primary Examiner*—Saxfield Chatmon

*Attorney, Agent, or Firm*—Gerald L. Cline

[57] ABSTRACT

An improved electron gun is shown with a cathode having a smooth, concaved surface and a grooved pattern therein which matches, and is aligned with, the pattern of a shadow grid placed immediately before the cathode surface so that the outer, larger radius of curvature of the shadow grid closest to the cathode is substantially identical and concentric with the radius of curvature of the smooth, concave cathode surface. Beyond the shadow grid is a control grid which controls the flow of electrons emitted from the cathode toward an anode. The grooves which form the pattern within the cathode surface have tapered side walls and rounded outer and inner corners to improve the flow of emitted electrons and facilitate manufacture.

19 Claims, 9 Drawing Figures

ELECTRON GUN WITH IMPROVED CATHODE AND SHADOW GRID CONFIGURATION

The present invention relates to an improved electron gun and, more particularly, to a cathode and grid configuration which improves the flow of electrons by utilizing a grooved cathode surface, grooved to match the configuration of the shadow grid immediately adjacent thereto.

BACKGROUND OF THE INVENTION

It is well known in the art to utilize an electron gun within a traveling-wave tube (TWT) or other charged particle device such as a linear accelerator, a free electron laser, a switch tube or a crossed-field tube. A TWT, in particular, is a broad-band, microwave tube which depends for its characteristics upon interaction between the electric field of a wave propagated along a wave guide and a beam of electrons traveling with the wave. In this tube, the electrons in the beam travel with velocities slightly greater than that of the wave, and, on the average, are slowed down by the field of the wave. Thus, the loss in kinetic energy of the electrons appears as an increased energy conveyed by the field to the wave. The TWT therefore, may be used as an amplifier or as an oscillator.

The electron gun which forms the heart of the TWT is typically formed with a cathode and anode between which are disposed grids. An electron gun showing such an arrangement may be found in prior U.S. Pat. No. 3,558,967, issued Jan. 26, 1971, by George V. Miram. The Miram patent utilizes a control grid and a shadow grid having the same pattern for the purpose of selectively blocking electron flow from the cathode to the control grid thereby preventing excessive heating of the control grid by electron bombardment. The shadow grid placed adjacent to the cathode causes distortion of the electric fields. This creates electron trajectories in the beam of electrons flowing from the cathode toward the anode to cross over one another and diverge from the desired laminar flow. Such crossing trajectories create serious heating problems when the stray electrons strike parts of the microwave tube structure downstream from the electron gun. The Miram reference overcomes this defocusing problem by either imbedding the shadow grid within the cathode or recessing the shadow grid in a recessed pattern within the surface of the cathode.

When the shadow grid is imbedded within the cathode, the result is a serious shortening of the cathode life due to the poisoning of the cathode by the contacting grid or due to grid emission resulting from migration of the emissive material onto the grid. The second Miram solution is to recess the grid in a noncontact manner within square cornered grooves in the surface of the cathode. In either solution that the Miram reference teaches, the spacings are impractically small. These small spacings provide less than optimum electron optics. Furthermore, the Miram reference teaches the need for relieving the surface of the cathode to form dimples between the recessed shadow screen. These dimples, or secondary concaved surfaces, are intended to form tiny beamlets which are ultimately focused into a single unitary linear beam after passage through the shadow and control grids.

One disadvantage of forming dimples, or secondary concaved emitter surfaces, within the concaved surface of the cathode is the added fabrication steps required. Further, each dimple must be symmetrical about its center. Thus, the pattern of the shadow grid and accompanying control grid or grids is needlessly complicated in order to match the symmetry of the dimpled pattern. This requires tighter grid tolerances and creates alignment problems. Finally, the pattern of grooves on the cathode surface is unnecessarily complex and difficult to manufacture.

After the suggested use of an imbedded shadow grid, Miram taught the use of a spherically-concaved and dimpled cathode surface, together with a pair of axially-spaced, spherically-concaved, focus-and-control grids in his coinvention, U.S. Pat. No. 3,983,446, which issued Sept. 28, 1976. Other U.S. patents which show grooved control grids may be found in U.S. Pat. No. 3,500,107 which issued Mar. 10, 1970, by J. E. Beggs and U.S. Pat. No. 2,977,496 which issued Mar. 28, 1961 by H. D. Doolittle. These patents show a grooved, spherical, cylindrical or flat-surfaced cathode, respectively. Except for the flat-surfaced cathode shown in the Beggs patent, the curved cathode surfaces are each shown with secondary curved surfaces that are difficult to machine or otherwise fabricate.

A copending patent application, Ser. No. 362,790, filed Mar. 28, 1982, by Richard B. True, entitled Improved Dual-Mode Electron Gun, assigned to the same assignee as the present invention, shows the use of a smooth, concaved cathode in a dual-mode electron gun. However, this reference used a shadow grid with two distinct patterns of conductive elements and a varying potential to accomplish its dual-mode function. It does not teach an improved cathode and shadow grid configuration.

SUMMARY OF THE INVENTION

Accordingly, it is the object of the present invention to provide an improved electron gun which eliminates the dimpled cathode and provides a more laminar flow of electrons emitted from the cathode toward the anode.

Another object of the invention is to provide an improved electron gun with a simplified cathode surface which is more easily fabricated than prior art cathodes.

A further object of this invention is to create an improved groove configuration within the cathode surface and a simplified relationship between such grooves and the shadow grid.

In accomplishing these and other objects, there is provided an improved electron gun having a smooth, single-concaved, electron-emitting surface disposed in juxtaposition with an anode between which is mounted a pair of grids. The first grid adjacent to the smooth, single-concaved surface is a shadow grid which is formed with a pattern of conductive elements and which is aligned with a control grid upon which is also formed a substantially similar pattern of aligned, conductive elements. The smooth, single-concaved surface of the cathode is relieved by a plurality of grooves which matches the pattern of the shadow and control grids. The outer surface of the shadow grid is substantially aligned with the emitter surface of the cathode. By utilizing the grooved pattern behind the shadow grid, the laminar flow of electrons from the cathode is improved. Using this arrangement, it has been found that it is unnecessary to dimple the concaved, electron-emitting surface of the cathode, as in the prior art.

DESCRIPTION OF THE DRAWINGS

Further objects and advantages of the present invention will become apparent after consideration of the following specification and accompanying drawings, wherein:

FIG. 9 is a cross-sectional view illustrating the flow of an electron beam from the prior art cathode of FIG. 4.

DESCRIPTION OF THE PREFERRED EMBODIMENTS

Figure 1:
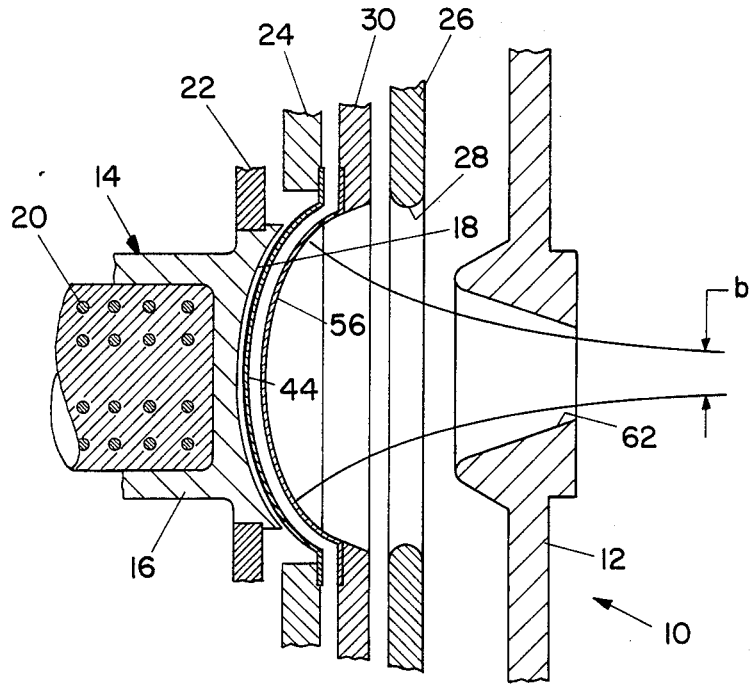
FIG. 1 is a cross-sectional, schematic view of an electron gun showing the improved cathode and shadow grid configuration of the present invention.

Referring now to the drawings, FIG. 1 shows an electron gun 10 having an anode 12 and a cathode assembly 14. The cathode assembly 14 consists of a thermionic cathode dispenser 16 provided with a smooth, single-concaved, electron-emitting surface 18 which is heated by an encapsulated heating coil 20. The encapsulated heating coil 20 nests within a counterboard aperture in dispenser 16 that, in turn, mounts within a conductive collar 22 which fits snugly within a mounting housing, not shown.

Mounted upon the outer end of a housing ring 24 is a shadow grid 44 which may be manufactured by photoetching or electrical-discharge machining a thin, preformed sheet of molybdenum, hafnium, or an alloy of copper and zirconium sold under the trade name of Amzirc. The shadow grid, in the preferred embodiment, is 0.003 inches thick. The relationship between the shadow grid 44 and the cathode surface 18 is shown in greater detail in FIGS. 2, 7 and 8.

A focusing electrode 26 whose annular opening 28 is disposed between the cathode 16 and anode 12 is mounted within the housing, not shown. Mounted between the focusing electrode 26 and ring 24 is a second ring 30 having a toroidal shape with an inner surface upon which is mounted a control grid 56 formed in a manner similar to the formation of shadow grid 44. Control grid 56 fits concentrically within the spherically-shaped shadow grid 44.

Figure 2:
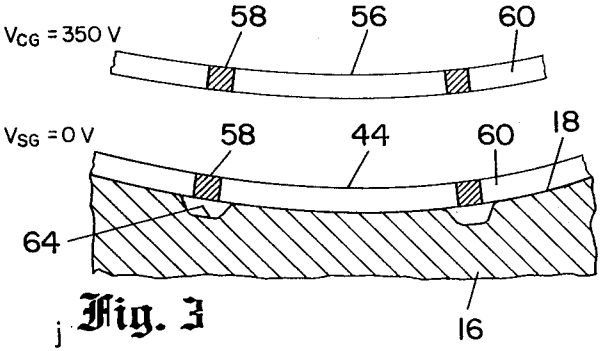
FIG. 2 is a detailed schematic representation, shown in cross-section, illustrating the present invention.
Figure 7:
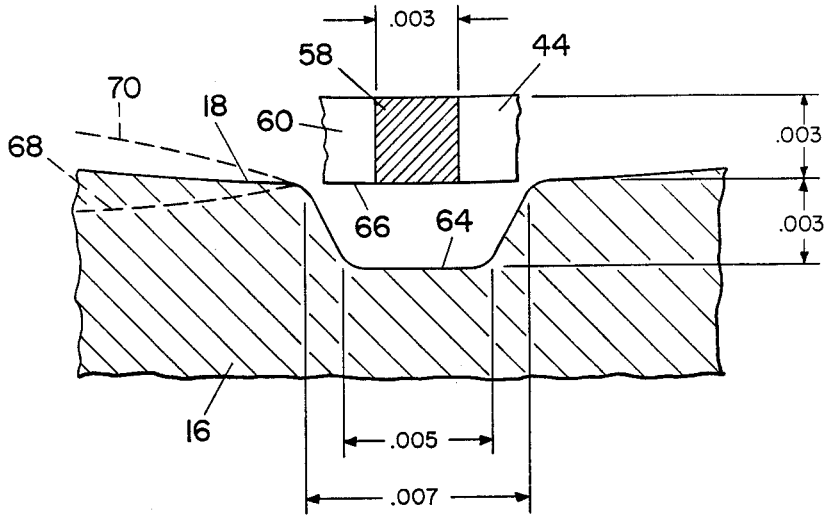
FIG. 7 is a detailed cross-sectional view showing the interrelationship between the shadow grid and the cathode of the present invention.

Each of the grids 44 and 56 are provided with circular conductive elements 58, FIGS. 2 and 7, which are connected to one another by radiating conductive elements 60. It will be understood that the grids, 44 and 56, may be formed in several configurations within the preferred embodiment. That is, the grids may be constructed by arranging conductive elements into a particular pattern or by placing apertures within a conductive sheet leaving the remaining material to form the conductive elements of the grids. It will also be understood that the shadow grid 44 is arranged between the cathode 16 and the control grid 56 to prevent the electrons emitted from surface 18 of cathode 16 from striking the control grid 56 and thus heating the control grid. Therefore, in most embodiments, the pattern of the shadow grid 44 and control grid 56 is identical. However, this is not necessary within the teachings of this invention. Nor is this invention limited to a single control grid, as two or more such grids are often used.

In operation, electrons escape from the smooth, concaved surface 18 of cathode 16 and pass through the grids 44 and 56 to be accelerated toward a tapered annular opening 62 with the anode 12. The electrons are thus formed into a beam "b" by the action of the control grids 44 and 56, the focusing electrode 26 and the anode opening 62.

As seen in FIG. 2, the smooth, concaved surface 18 of the electrode 16 is provided with a plurality of grooves 64 which are arranged in a pattern identical to the pattern of the shadow grid 44. Grooves 64 are machined or etched into the surface 18 of cathode 16 and provide a region of greatly reduced (negligible) electron emissivity which, in combination with the conductive element 58 of the shadow grid 44, acts to produce a laminar flow of electrons from the surface 18 of cathode of 16. It will be seen in FIGS. 2 and 7 that the conductive elements 58 and 60 which form the shadow grid 44 are spherically shaped with an outer surface radius 66 that is equal to the radius of curvature of the cathode surface 18. Further, the shadow grid 44 is arranged so that its outer radius lies substantially in the same plane as the radius of curvature of surface 18. In a preferred embodiment, this line-to-line configuration provides for the smoothest flow of emitted electrons. However, it will be understood that the exact location of the shadow grid 44 may be varied so that the grid 44 is actually recessed within groove 64 or placed just outside of the radius of curvature which forms the concave surface 18.

Figure 3:
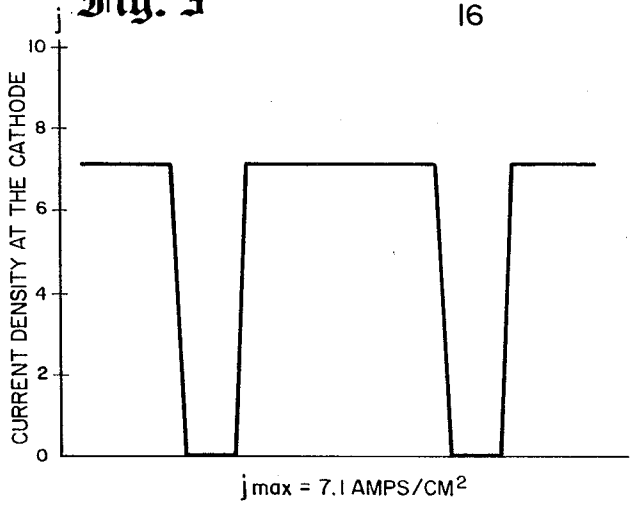
FIG. 3 shows a plot of current density across the surface of the cathode of the present invention.

FIG. 3 shows a plot of calculated current density across the surface 18 of cathode 16. The maximum current density has been determined to equal 7.1 amps/cm$^2$ when the voltage upon the shadow grid 44 is zero volts and the voltage upon the control grid 56 is 350 volts, as shown in FIG. 2.

Figure 4:
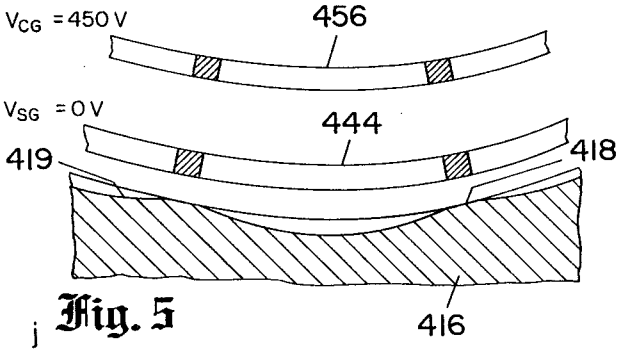
Fig. 4 PRIOR ART
FIG. 4 is a schematic representation, shown in cross-section, similar to FIG. 2 showing a prior art electron gun.
Figure 5:
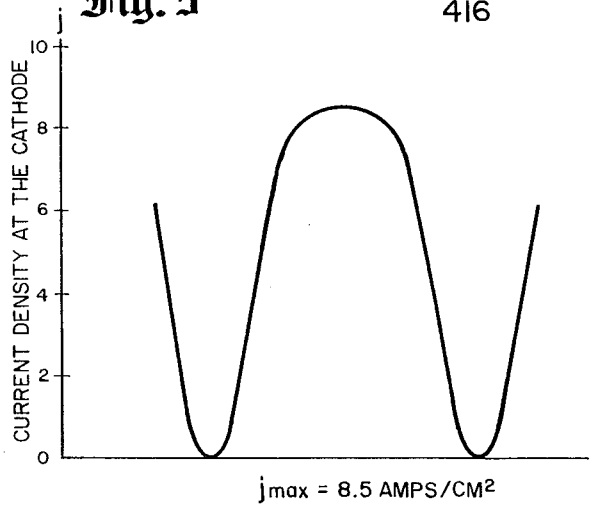
FIG. 5 is a plot of current density across the surface of the cathode shown in FIG. 4, similar to FIG. 3.

Referring now to FIGS. 4 and 5, a comparison is made between the improved cathode and shadow grid configuration of the present invention, FIG. 2, and the prior art, FIG. 4. In the prior art, the cathode 416 has a spherical surface 418 which includes a plurality of dimpled, or secondary spherical surfaces 419. The shadow grid 444 is spaced apart from the surface 418 of the cathode while the control grid 456 is aligned behind the shadow grid. FIG. 5 shows a plot of the current density across the surface of the cathode 416. In the prior art, the shadow grid 444 is maintained at zero volts while the control grid is maintained at 450 volts. In this configuration, the maximum current density across the face of the cathode is 8.5 amps/cm$^2$.

It should be noted that the present invention permits the control grid 56 to be operated at a lower voltage than prior art arrangements, while the cathode peak loading is also lower. The effect of reducing the cathode peak loading for the same cathode current is that the cathode may be operated at a lower temperature resulting in a longer life expectancy than in prior art arrangements.

Figure 6:
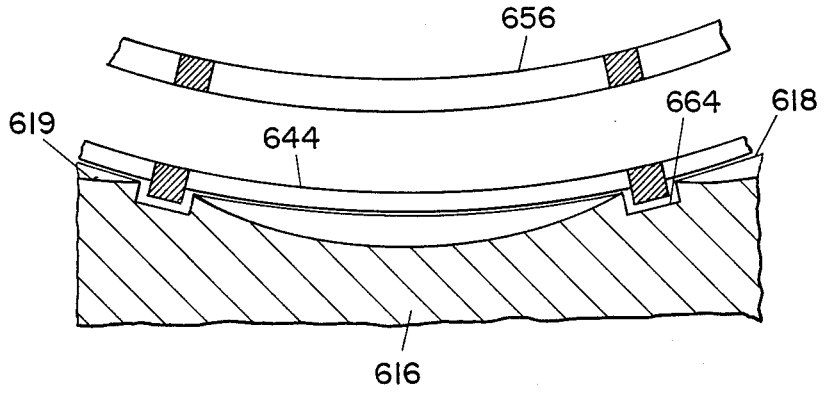
Fig. 6 PRIOR ART
FIG. 6 is a schematic representation, shown in cross-section, of another prior art cathode and shadow grid arrangement.

As mentioned above under the Background Of The Invention, another prior art arrangement, FIG. 6, includes the concept of placing the shadow grid 644 within grooves 664 in the spherical surface 618 of the cathode 616. This prior art arrangement also utilized a control grid 656 having the same pattern as the shadow grid 644. While the prior art taught the utilization of grooves 664 within the surface 618 of cathode 616, the prior art still required the use of dimples 619, or secondary-concaved surfaces, across the concaved surface 618. The present invention has discovered that the dimpling of surface 618 is no longer necessary to obtain a smooth laminar flow of electrons from surface 618 of the cathode.

Figure 8:
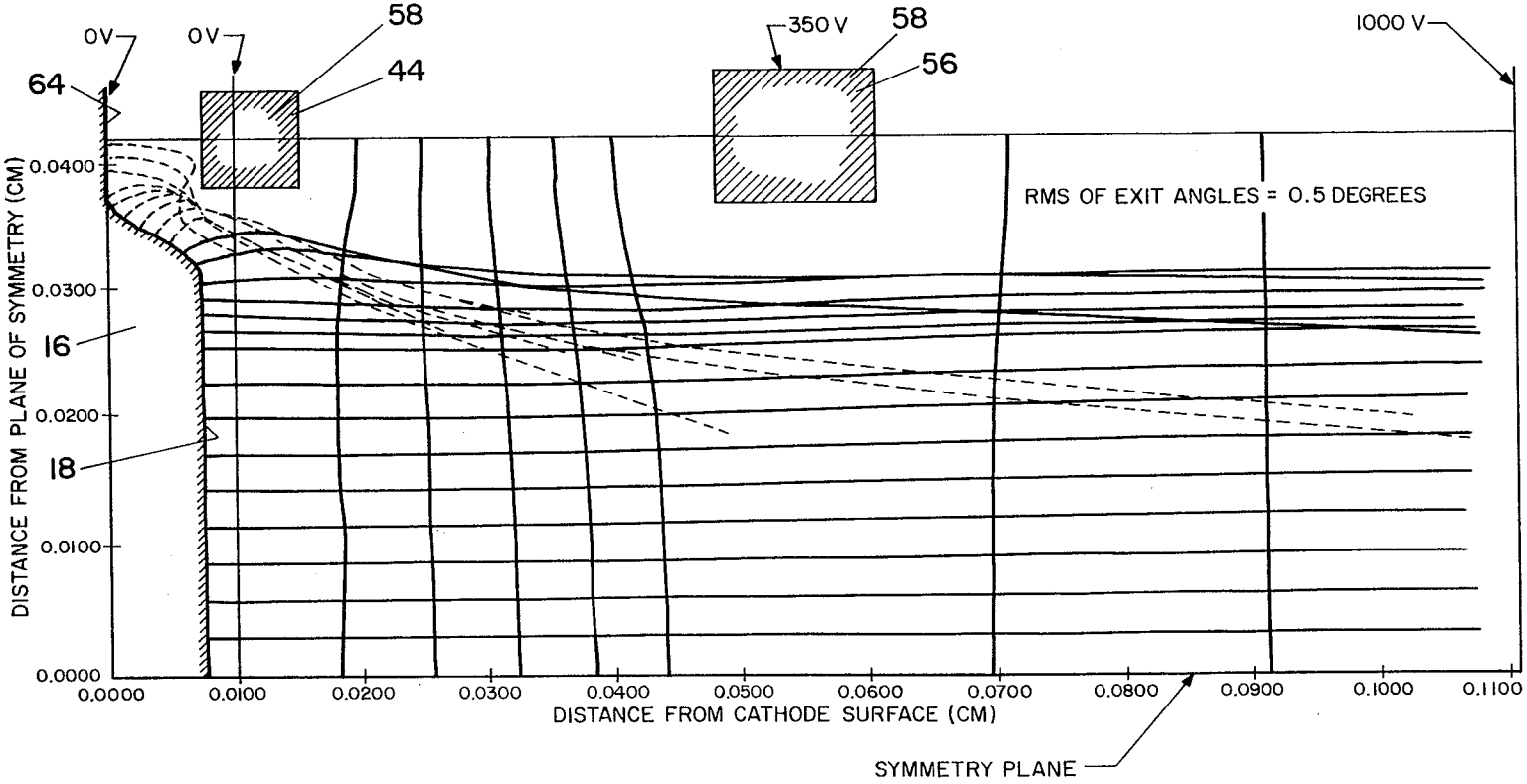
FIG. 8 is a cross-sectional view illustrating the flow of an electron beam from a segment of the grooved cathode of the present invention.
Figure 11:
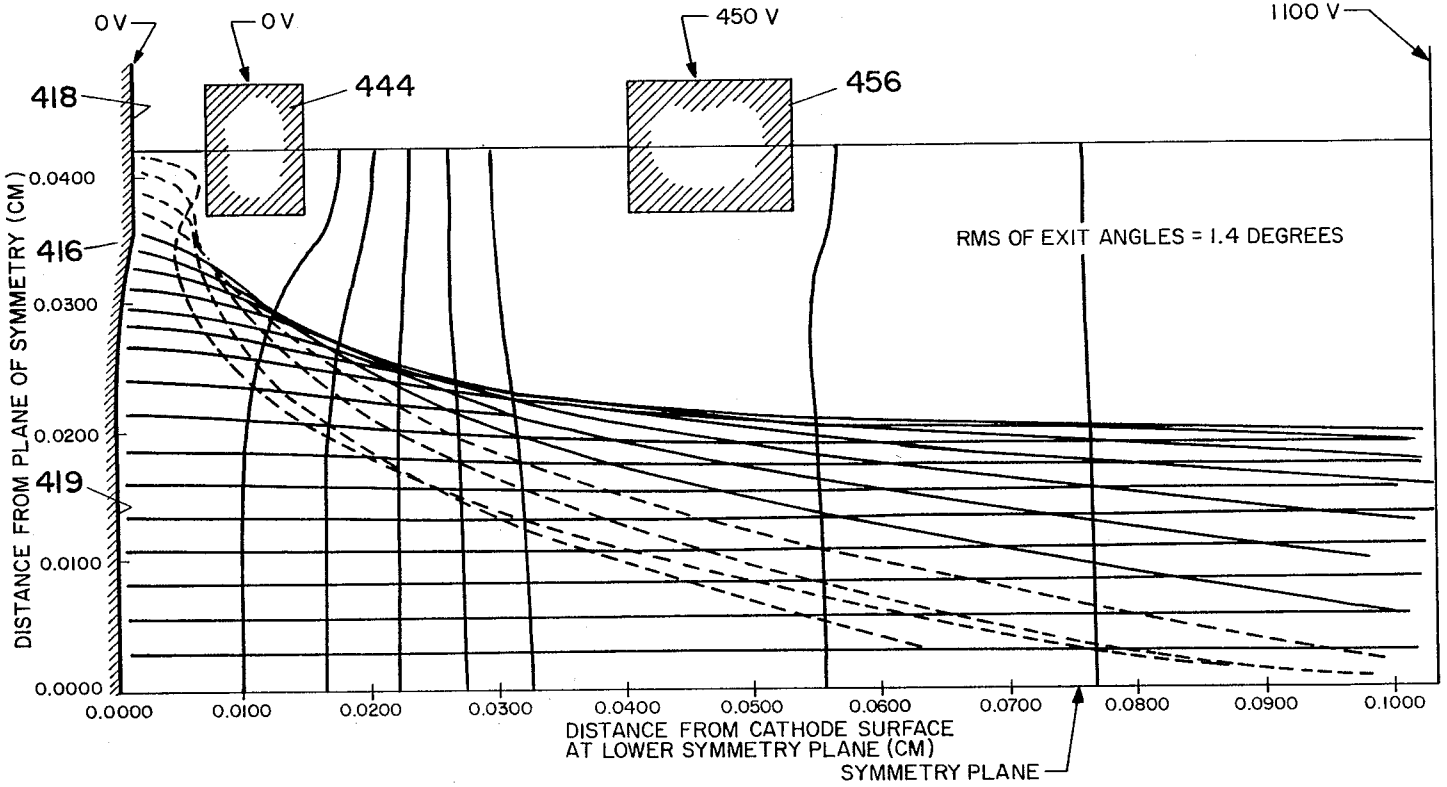
Fig. 11 PRIOR ART

Referring now to FIG. 7, the details of the grooves 64 in cathode 16 and conductive elements 58 of the shadow grid 44 are shown. It will be noted that the grooves 64 are not square-sided grooves, as shown in the prior art. Rather, the grooves have rounded upper and lower corners with tapered side walls to provide an improved flow of electrons, as shown in FIG. 8. The outer radius 66 of the shadow grid 44 is substantially aligned with the radius of curvature of the concaved surface 18 of cathode 16. It will be seen that the 0.003 inch element 58 is square and aligned symmetrically over a 0.003 inch deep groove whose inner side is 0.005 inches long and whose outer side opening is 0.007 inches long. While the exact dimensions of the groove configuration may be varied, the preferred groove configuration is shown. FIG. 7 shows the smooth, concaved surface 18 of cathode 16. However, as discussed below, a second dimpled surface 64, shown by a single dashed line 68, may be used. Alternately, a second convexed surface, shown by the dashed line 70, may be used.

Referring now to FIG. 8, electron flow from the cathode surface 18 past grids 44 and 56 toward the anode 12 is shown through the utilization of a computer plot which simulates such flow in a small segment of the electron gun 10. In FIG. 8, the generally horizontal lines represent a computer plot of the electron current as the electrons flow from the cathode surface 18 toward the anode 12. The y axis shows the distance in centimeters of the individual conductive elements 58 which form the shadow grid 44 and control grid 56 from the plane of symmetry, while the x axis shows the distance in centimeters from the cathode surface.

By comparing FIGS. 8 and 9, one can readily see the improvement in the laminar flow of electrons between the cathode and anode as they pass by the control and shadow grids. In FIG. 8, the present invention is illustrated showing the smooth, concaved surface 18 of the cathode 16 relieved by grooves 64 wherein the conductive elements 58 of shadow grid 44 are aligned with their outer radius substantially matched with the radius of curvature of the cathode surface 18. It will be seen from the diagram that the root-mean-square (RMS) of exit angles from the cathode surface is 0.5 degrees.

When comparing this with the prior art arrangement shown in FIG. 9, which is a plot of the configuration of FIG. 4, one can see that the flow of electrons emitted from the cathode surface 418 past the shadow grid 444 and control grid 456 is more turbulent than in FIG. 8. In fact, the RMS of the exit angles is 1.4 degrees compared to 0.5 degrees in FIG. 8. It should also be noted that the electrons emitted behind the shadow grid carry more of the total current in FIG. 9 than in FIG. 8. The calculations indicate that 0.4% of the total cathode current is emitted behind the shadow grid 444 (shown by dashed lines) in the conventional gun shown in FIG. 9, while but 0.3% of the total cathode current is emitted behind the shadow grid 44 (also shown by dashed lines) in FIG. 8.

The improved arrangement of FIG. 8 permits the control grid to be operated at a lower voltage and the cathode to be operated at a lower peak loading than their counterparts shown in FIG. 9. The lower peak cathode loading, as mentioned above, improves the life of the electron gun by lowering the required cathode operating temperature. The voltage used within the present embodiment maintains the anode 12 at a 25 kilovolt potential above the cathode 16. Obviously, other voltages may also be used. Note, that FIGS. 8 and 9 show a fictitious anode voltage of 1000 volts and 1100 volts, respectively, to simulate the electric field generated by the anode voltage of 25 kilovolts for computational purposes. The shadow grid 44, of the present embodiment, is maintained at 0 volts above the cathode, while the control grid 56 is 350 volts above the cathode potential. The electron gun of present embodiment may be operated between 1 kilovolt to 65 kilovolts. In this case, the shadow grid 44 remains at 0 volts while the control grid 56 may vary proportionally between 14 volts and 910 volts.

A review of FIG. 8 in the area of the rounded and tapered surfaces of the groove 64 will illustrate how the rounded corners and tapered side walls aid the laminar flow of electrons emitted from the grooved cathode surface 18. These rounded and tapered surfaces are also more practical to manufacture than sharp square surfaces. The exact configuration of groove 64 and the depth at which the shadow grid 44 is inserted into the groove or placed above the groove may vary within the teachings of the present invention. The preferred arrangement is an aligned configuration. Another major importance of the shaped grooves 64 of the present invention is that they reduce the cathode current behind the shadow grid 44 and produce more uniform current density between the grooves. This increased uniformity reduces the peak cathode loading which in turn, allows the cathode temperature to be reduced and tube life prolonged.

While the cathode surface 18 is a smooth, concave surface in the preferred embodiment, it has been found that the surfaces between conductive elements 58 may be convexed in some configurations for defocusing the flow of electrons. In this arrangement, the spreading flow is refocused by the control grid 56, which in some embodiments, improves the focus of the resultant beam. In other arrangements, the rounded and tapered surfaces of grooves 64 work well with dimpled surfaces between the elements 58, as in the prior art.

The control grid 56 may be formed from more than one grid, as in a dual mode electron gun. Further, it is possible that in some applications, the shadow grid 44 may be formed from more than one grid. While other variations are possible, the present invention should be limited only by the appended claims.

We claim:

1. An improved electron gun, comprising:

an anode;

a thermionic cathode having a smooth, single-concaved, electron-emitting surface;

a control grid having a pattern of conductive elements;

a shadow grid having a pattern of conductive elements;

said smooth, single-concaved surface of said cathode having a grooved pattern therein which matches and is aligned with and under the pattern of said shadow grid, wherein said grooved, smooth, single-concaved surface of said cathode promotes the linear flow of electron from said electrons emitting surface around said shadow and control grids into a linear beam toward said anode.

2. An improved electron gun, as claimed in claim 1, wherein:

said control grid is at least one control grid;

said shadow grid is at least one shadow grid; and at least a portion of said at least one shadow grid pattern of conductive elements substantially matches at least a portion of the pattern of conductive elements of said at least one control grid and is aligned therewith.

3. An improved electron gun, as claimed in claim 1, wherein:

said shadow grid and control grid have spherical radii of curvature which substantially match the spherical radius of curvature of said smooth, single-concaved surface of said cathode.

4. An improved electron gun, as claimed in claim 1, wherein:

said shadow grid is recessed into said grooved pattern in said smooth, single-concaved surface of said cathode.

5. An improved electron gun, as claimed in claim 1, wherein:

said shadow grid has an outer surface radius;

said smooth, single-concaved surface of said cathode has a radius of curvature which is equal to said outer surface radius of said shadow grid; and said outer surface radius of said shadow grid is arranged in substantial line-to-line alignment with said radius of curvature of said smooth, concaved surface wherein said grooved pattern prevents contact therebetween.

6. An improved electron gun, as claimed in claim 1, wherein:

said shadow grid is mounted slightly beyond said grooved pattern in said smooth, single-concaved surface toward said control grid.

7. An improved electron gun, as claimed in claim 1, additionally comprising:

means for applying a voltage between 1 kilovolt to 65 kilovolts between said anode and said cathode;

means for applying a positive voltage between 14 volts to 910 volts to said control grid compared to said cathode; and means for maintaining said shadow grid at zero voltage compared to said cathode.

8. An improved electron gun, as claimed in claim 7, wherein:

said voltage applied between said anode and said cathode is 25 kilovolts; and said voltage applied to said control grid is 350 volts.

9. An improved electron gun, as claimed in claim 1, wherein:

said grooved pattern within said smooth, concaved cathode surface is formed from grooves having tapered side walls and rounded inner and outer corners, wherein said linear flow of electrons from said cathode toward said anode is improved.

10. An improved electron gun, comprising:

an anode;

a cathode having an inner radius of curvature which forms a smooth, concaved, electron-emitting surface;

said concaved surface having a pattern of grooves across said surface, each groove having rounded inner and outer corners;

a first grid having a pattern of conductive elements which match, and are aligned with, said pattern of grooves in said cathode surface mounted adjacent to said cathode surface;

a second grid having a pattern of conductive elements which substantially match, and are aligned with, said first grid mounted adjacent to said first grid;

wherein said grooves reduce the amount of electron current emitted from said cathode surface behind each conductive element of said first grid and increase the uniformity of electron current density emitted from said cathode surface between said grooves.

11. An improved electron gun, as claimed in claim 10, wherein:

said grooves within the surface of said cathode having tapered side walls.

12. An improved electron gun, as claimed in claim 10, wherein:

said first grid has an outer surface radius that equals said inner radius of curvature of said concaved cathode surface and which is substantially aligned therewith, wherein said grooves prevent contact of said first grid and said cathode surface and reduce cathode current therebetween.

13. An improved electron gun, as claimed in claim 10, additionally comprising:

means for applying a voltage between 1 kilovolt and 65 kilovolts between said anode and said cathode;

means for applying a positive voltage between 14 volts and 910 volts to said control grid compared to said cathode; and means for maintaining said shadow grid at a zero voltage compared to said cathode.

14. An improved electron gun, as claimed in claim 13, wherein:

said voltage applied between said anode and said cathode is 25 kilovolts; and said voltage applied to said control grid is 350 volts.

15. An improved electron gun, comprising:

an anode;

a cathode having a generally concaved surface;

said concaved surface having a pattern of grooves across said surface;

said grooves having rounded inner and outer corner and tapered side walls;

a shadow grid having a pattern of conductive elements which match and are aligned with said pattern of grooves in said cathode surface mounted adjacent thereto;

a control grid having a pattern of conductive elements which substantially match and are aligned with said conductive elements of said shadow grid mounted adjacent thereto;

wherein said grooves reduce the amount of cathode current between said grooves and aligned conductive elements of said shadow grid.

16. An improved electron gun, as claimed in claim 15, additionally comprising:

said generally concaved surface of said cathode in a smooth surface.

17. An improved electron gun, as claimed in claim 15 additionally comprising:

said generally concaved surface of said cathode has secondary convexed surfaces between said grooves.

18. An improved electron gun, as claimed in claim 15, additionally comprising:

said generally concaved surface of said cathode has secondary concaved surfaces between said grooves.

19. An improved electron gun, as claimed in claim 15, additionally comprising:

said generally concaved surface of said cathode having a radius of curvature;

said shadow grid having an outer surface radius generally equal to said radius of curvature of said cathode surface is substantially aligned with said outer surface radius of said electron gun.

* * * * *